US007325264B2

(12) United States Patent
Holmes

(10) Patent No.: US 7,325,264 B2
(45) Date of Patent: Feb. 5, 2008

(54) MULTIPURPOSE COT CARRIER

(76) Inventor: Scott Holmes, 4544 Cambridge Dr., Cedar Hills, UT (US) 84062

( * ) Notice: Subject to any disclaimer, the term of this patent is extended or adjusted under 35 U.S.C. 154(b) by 0 days.

(21) Appl. No.: 11/443,677

(22) Filed: May 31, 2006

(65) Prior Publication Data

US 2007/0277316 A1 Dec. 6, 2007

(51) Int. Cl.
*A47C 21/00* (2006.01)
*A47C 17/64* (2006.01)

(52) U.S. Cl. ..... 5/503.1; 5/114

(58) Field of Classification Search ..... 5/503.1, 5/658, 663, 656, 110, 112, 114, 115, 117; 383/6, 7, 15, 16, 22, 24, 38, 39; 224/156, 224/923

See application file for complete search history.

(56) References Cited

U.S. PATENT DOCUMENTS

| | | | | | |
|---|---|---|---|---|---|
| 97,981 | A | * | 12/1869 | Snead | 5/9.1 |
| 325,879 | A | * | 9/1885 | Vuitton | 190/2 |
| 633,525 | A | * | 9/1899 | Martindale | 5/114 |
| 1,524,065 | A | * | 1/1925 | Timpson | 5/658 |
| 1,788,370 | A | * | 1/1931 | De Long et al. | 5/308 |
| 2,761,481 | A | * | 9/1956 | Boatwright | 383/22 |
| 3,599,690 | A | * | 8/1971 | Christie | 383/15 |
| 3,699,593 | A | * | 10/1972 | Oetiker | 5/111 |
| 3,838,758 | A | * | 10/1974 | Brown | 383/38 |
| 3,965,502 | A | * | 6/1976 | Bertram | 5/111 |
| 3,967,666 | A | | 7/1976 | Farrar | |
| 4,034,518 | A | * | 7/1977 | Trecker | 5/114 |
| 4,235,350 | A | * | 11/1980 | Valentino | 220/495.1 |
| 4,610,476 | A | * | 9/1986 | Keiner | 294/149 |
| 5,251,945 | A | * | 10/1993 | Stoops | 294/152 |
| 5,370,246 | A | * | 12/1994 | Traynor | 211/86.01 |
| 5,651,152 | A | * | 7/1997 | Ritchie et al. | 5/503.1 |
| 5,863,088 | A | * | 1/1999 | Kelly et al. | 294/146 |
| 5,941,437 | A | * | 8/1999 | Okumura | 224/585 |
| D418,295 | S | * | 1/2000 | Verhulst | D3/303 |
| D420,510 | S | * | 2/2000 | Rotan | D3/303 |
| 6,148,459 | A | | 11/2000 | Verhulst | |
| 6,233,765 | B1 | | 5/2001 | Verhulst | |
| 6,250,470 | B1 | * | 6/2001 | Mackenzie | 206/579 |
| 6,328,146 | B1 | * | 12/2001 | Siwak | 190/109 |
| 6,347,419 | B1 | * | 2/2002 | Kurtz | 5/503.1 |
| 6,553,586 | B1 | | 4/2003 | Lin | |
| 6,704,952 | B2 | * | 3/2004 | Kurtz | 5/308 |
| 6,763,534 | B2 | * | 7/2004 | Hwang | 5/114 |
| 6,793,051 | B2 | * | 9/2004 | Siwak | 190/111 |
| 6,928,950 | B2 | * | 8/2005 | Trammell et al. | 114/382 |
| 6,938,288 | B2 | * | 9/2005 | Hunter et al. | 5/114 |
| 6,966,439 | B2 | * | 11/2005 | Weleczki | 206/315.3 |
| D522,750 | S | * | 6/2006 | Girod | D3/303 |
| 7,137,493 | B2 | * | 11/2006 | Siwak | 190/111 |
| 2001/0042665 | A1 | * | 11/2001 | Siwak | 190/111 |
| 2003/0024960 | A1 | * | 2/2003 | Greenstein et al. | 224/153 |
| 2003/0159214 | A1 | * | 8/2003 | Kutz | 5/503.1 |

(Continued)

*Primary Examiner*—Robert G. Santos
(74) *Attorney, Agent, or Firm*—Jeffrey R. Jeppsen; AdvantEdge Law Group, LLC

(57) ABSTRACT

An exemplary apparatus includes a main body forming a compartment, the compartment being configured to receive a cot in a stow position, at least one attachment mechanism attached to the main body, the attachment mechanism being configured to attach the main body to the cot when the cot is in a sleep position, and at least one organizational mechanism attached to the main body.

7 Claims, 3 Drawing Sheets

U.S. PATENT DOCUMENTS

2004/0034929 A1* 2/2004 Hwang ..... 5/114
2005/0011002 A1* 1/2005 Hunter et al. ..... 5/9.1
2005/0045441 A1* 3/2005 Siwak ..... 190/111
2006/0196745 A1* 9/2006 Siwak ..... 190/110
2006/0260049 A1* 11/2006 Wenz ..... 5/503.1
2006/0291753 A1* 12/2006 Godshaw et al. ..... 383/4
2007/0025646 A1* 2/2007 Schoenig et al. ..... 383/4

* cited by examiner

MULTIPURPOSE COT CARRIER

BACKGROUND

Many people camp, recreate, or work in the outdoors. A wide variety of equipment is available for use with these types of outdoor activities, including tents, sleeping bags, cots, camp stoves, backpacks, flashlights, mess kits, etc. Unfortunately, a particular piece of outdoor equipment is often used only for a particular purpose and provides little or no utility aside from that purpose.

For example, some conventional outdoor equipment provides utility only during travel to and from a campsite. Once at the campsite, the usefulness of such equipment is significantly diminished. For instance, a conventional carry bag used to transport a particular piece of camping equipment (e.g., a sleeping bag or cot) typically loses its utility at the campsite once the camping equipment is removed from the carry bag. Moreover, equipment that has utility only during travel tends to undesirably occupy and clutter valuable and sometimes limited space at the campsite.

On the other hand, some conventional outdoor equipment provides utility only at the campsite. For example, conventional organizers designed for use at a campsite lose their utility during travel to and from the campsite. Moreover, equipment having utility only at the campsite increases the burden associated with travel by adding to the load that must be transported to and from the campsite.

In short, conventional single-purpose camping equipment tends to increase the number of articles that people have to store at and transport to/from campsites. Thus, there is a need for multi-purpose outdoor equipment that provides utility both at the campsite and during travel to and from the campsite.

SUMMARY

An exemplary apparatus includes a main body forming a compartment, the compartment being configured to receive a cot in a stow position, at least one attachment mechanism attached to the main body, the attachment mechanism being configured to attach the main body to the cot when the cot is in a sleep position, and at least one organizational mechanism attached to the main body.

BRIEF DESCRIPTION OF THE DRAWINGS

The accompanying drawings illustrate various embodiments of the present invention and are a part of the specification. The illustrated embodiments are merely examples of the present invention and do not limit the scope thereof.

Throughout the drawings, identical reference numbers designate similar, but not necessarily identical, elements.

DETAILED DESCRIPTION

The present specification discloses an exemplary multipurpose cot carrier. According to an exemplary embodiment, a multipurpose cot carrier is configured to carry a sleeping cot when the cot is in a stow position. Accordingly, the multipurpose cot carrier can be used to store and/or transport the cot. The cot carrier is also configured to be attached to the cot when the cot is in a sleep position such that at least one organizational mechanism attached to the cot carrier is made accessible for storing one or more items. Consequently, the multipurpose cot carrier can be used at a campsite to store and/or organize a wide variety of items including, but in no way limited to, camping items such as a water bottle, a flashlight, insect repellent, etc. The multipurpose cot carrier may also be configured to store and/or organize items during transport and/or storage of the cot. Because of its multiple uses, the cot carrier provides utility both at a campsite and during travel to/from the campsite.

In the following description, for purposes of explanation, numerous specific details are set forth in order to provide a thorough understanding of an exemplary multipurpose cot carrier. It will be apparent, however, to one skilled in the art, that other embodiments of the cot carrier may omit these specific details and/or include other specific details. Reference in the specification to "one embodiment" or "an embodiment" means that a particular feature, structure, or characteristic described in connection with the embodiment is included in at least one embodiment. Appearances of the phrase "in one embodiment" in various places in the specification are not necessarily all referring to the same embodiment.

Exemplary Assembly

Figure 1:
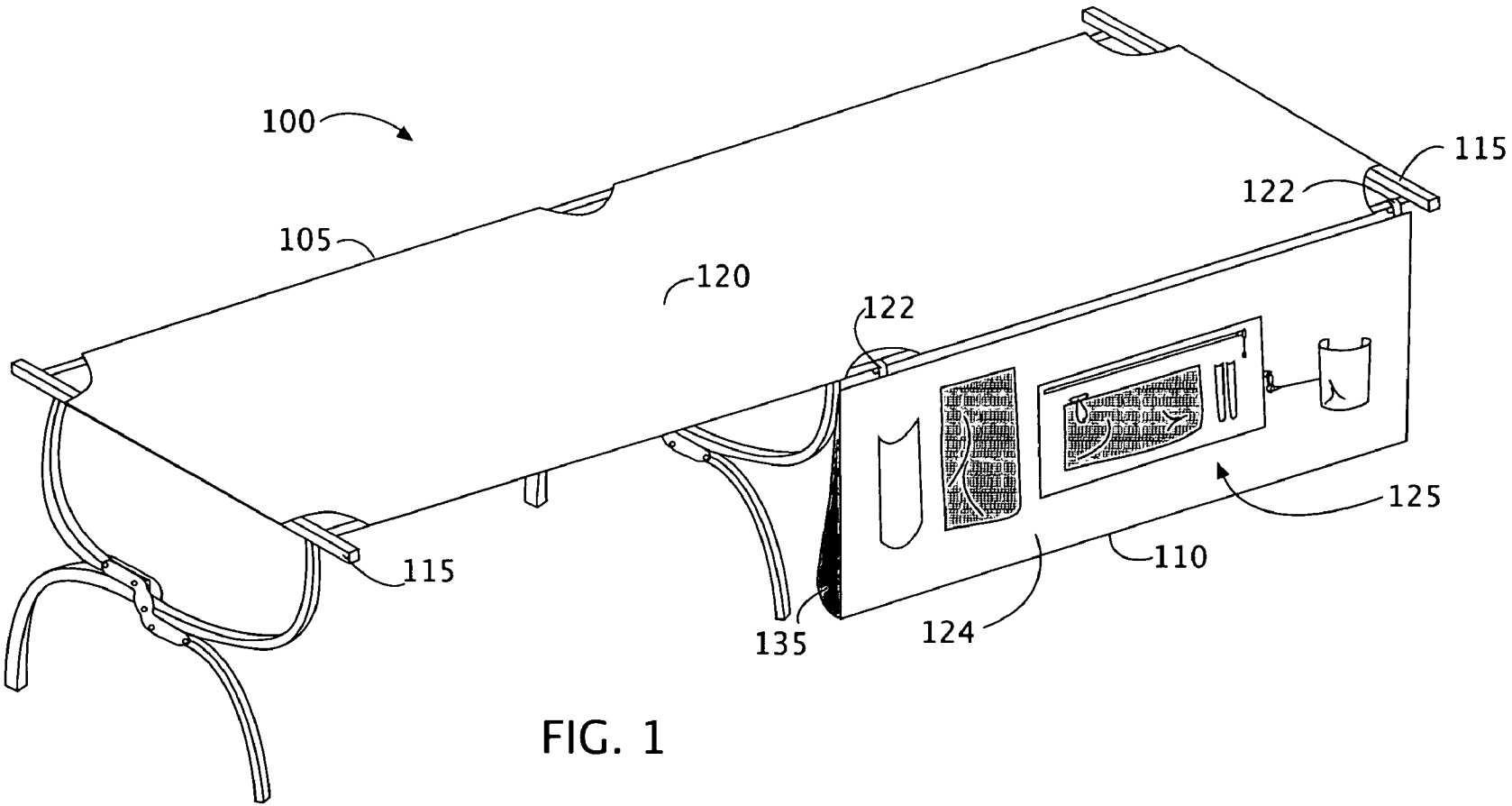
FIG. 1 is a perspective view of an exemplary assembly including an exemplary cot and an exemplary cot carrier attached to the cot, according to an embodiment.

FIG. 1 is a perspective view of an exemplary assembly [100] including an exemplary cot [105] and an exemplary cot carrier [110] attached to the cot [105], according to an embodiment.

The cot [105] may include a support frame [115] and a sleep surface [120] attached to the support frame [115] so as to provide support for a person positioned on the sleep surface [120] when the cot [105] is in a sleep position. Sleep position may refer to any position in which the cot [105] is set up to support a person on the sleep surface [120] of the cot [105].

The cot carrier [110] may be attached to the cot [105] in any suitable manner. For example, the cot carrier [110] may include at least one attachment mechanism [122] for securing the cot carrier [110] to the cot [105]. The attachment mechanism [122] may include any mechanism suitable for securing the cot carrier [110] to the cot [110]. In the assembly of FIG. 1, each attachment mechanism [122] includes a strap (e.g., a Velcro strap) configured to removably attach the cot carrier [110] to the support structure [115] of the cot [105]. However, this is not limiting, and other suitable types and numbers of mechanisms may be used to attach the cot carrier [110] to the cot [105].

The cot carrier [110] may be attached to the cot [105] in such a way as to allow a person to easily store and access items stored in the cot carrier [110]. As shown in FIG. 1, the cot carrier [110] may be attached to the support structure [115] such that the cot carrier [110] hangs generally along an edge of the cot [105].

The cot carrier [110] may include a main body [124] and at least one organizational mechanism [125] attached to the main body [124]. The organizational mechanism(s) [125] may be arranged so as to provide organizational tools that are convenient and accessible when the cot carrier is attached to the cot [105], as shown in FIG. 1. Accordingly, the cot carrier [110] is configured to function as an organization and/or storage tool whenever the cot [105] is in a sleep position (e.g., at a campsite). Examples of organizational mechanisms [125] will be described further below in reference to FIG. 3.

The main body [124] may be formed of a flexible material including, but in no way limited to, nylon polyester, ramie, and cotton canvas. The main body [124] may be formed by joining opposite ends of a single piece of the flexible material so as to create a compartment [135] of suitable size so as to receive the cot [105] when the cot [105] is in a stow position. Alternatively, the main body [124] of the cot [105] may include multiple pieces of flexible material arranged to form the compartment [135].

Figure 2:
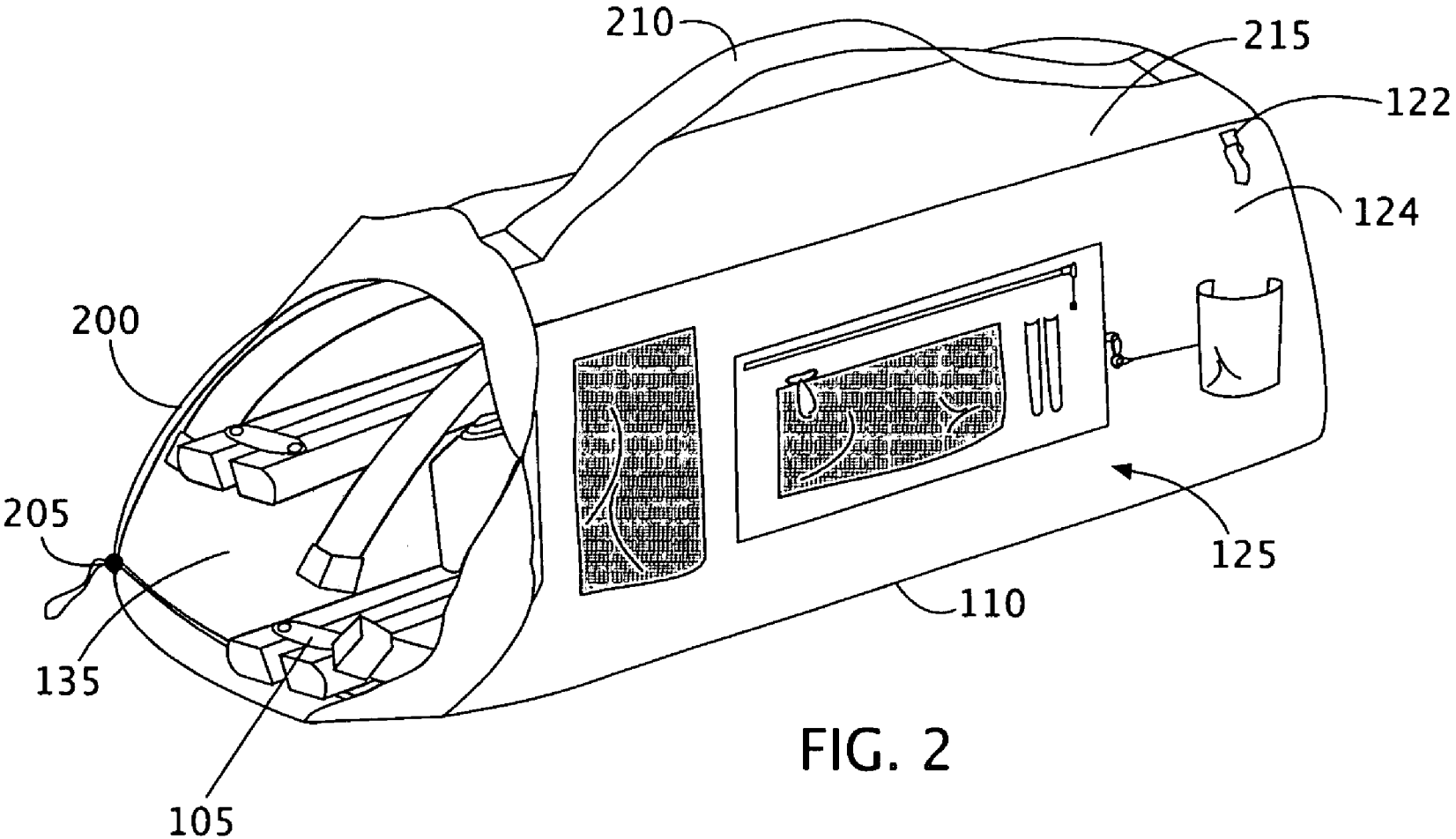
FIG. 2 is a perspective view of the assembly of FIG. 1 with the cot in a stow position and stored in the cot carrier, according to an embodiment.

FIG. 2 is a perspective view of the assembly [100] of FIG. 1 with the cot [105] in a stow position and stored in the cot carrier [110]. The cot [105] may be placed in a stow position and received in the compartment of the cot carrier [110]. Stow position refers to any position in which the cot [105] is compacted (e.g., folded) for reception in the compartment [135] of the cot carrier [110]. The cot [105] may be transitioned from a stow position to a sleep position and vice versa in any suitable manner, including any of the ways described in U.S. Pat. No. 6,553,586 to Lin, filed Dec. 26, 2001 and entitled FOLDING BED FRAME, the contents of which are hereby incorporated by reference in their entirety.

The cot [105] may be inserted into the compartment [135] through an opening [200]. The opening [200] may be formed at one end of the cot carrier [110]. The other end of the cot carrier [110] may be sealed such that the cot carrier [110] forms a carry bag capable of receiving and carrying the cot [105]. Accordingly, the cot carrier [110] provides utility for transporting and/or storing the cot [105].

The cot carrier [110] may include one or more mechanisms for securing the cot [105] in the compartment [135] of the cot carrier [110]. As shown in FIG. 2, for example, the cot carrier [110] may include a drawstring [205] arranged around the opening [200] of the compartment [135] and configured to constrict the opening [200] to secure the cot [105] in the compartment [135].

FIG. 2 further illustrates that the cot carrier [110] may include a carry mechanism [210] attached to an upper portion [215] of the main body [124] of the cot carrier [110]. The carry mechanism [210] may include a strap made of a flexible material, and may be attached to the upper portion [215] of the main body [124] by any suitable means known in the art. Of course, the cot carrier [210] may include any suitable type of carry mechanism.

It can also be seen in FIG. 2 that the organizational mechanisms [125] can still be used to organize and store items even during transport or storage of the cot [105]. In particular, the organizational mechanisms [125] and the carry mechanism [210] may be arranged in relation to each other such that the organization mechanisms [125] are positioned generally upright when the carry mechanism [210] is used to carry the cot carrier [110] for transport of the cot [105]. This further demonstrates the multipurpose nature of the cot carrier [110], whether it be used for organization, travel, or storage purposes.

Figure 3:
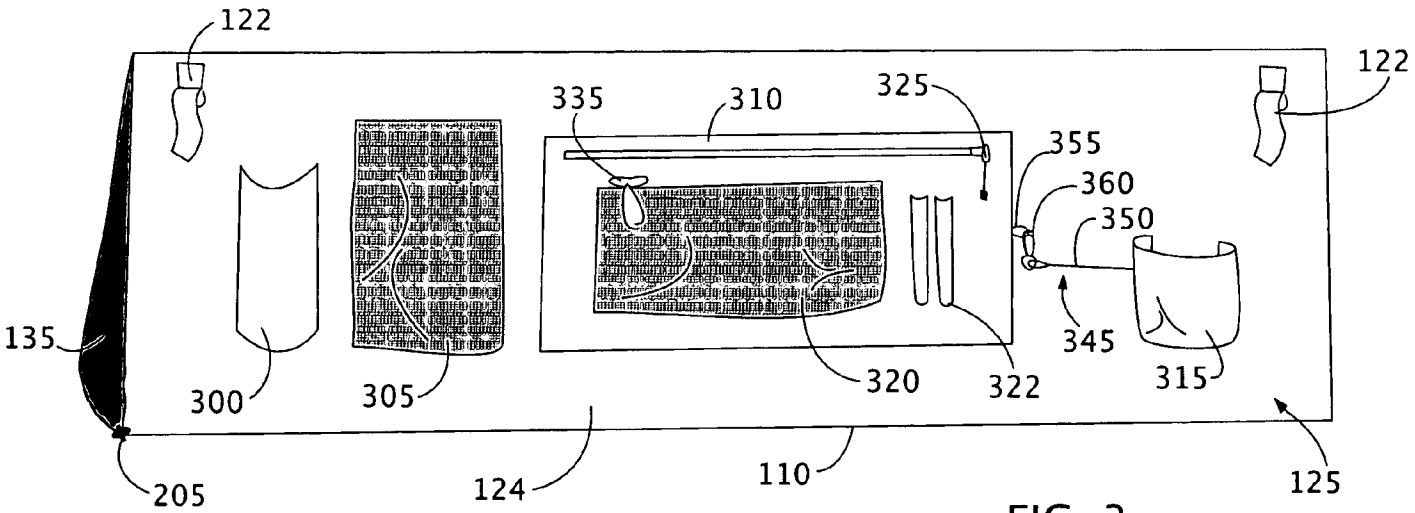
FIG. 3 is a generally frontal view of the cot carrier of FIG. 1, according to an embodiment.

FIG. 3 is a generally frontal view of the cot carrier [110] of FIG. 1. As shown in FIG. 3, the organizational mechanisms [125] may include a variety of pockets [300], [305], [310], [315] [320], and [322] for holding items such as wallets, tapes, clothing articles, toiletries, matches, medicines, maps, electronic devices, writing implements, flashlights, outdoor supplies, fishing tackle, camping items, etc. The pockets [300], [305], [310] and [315] may be formed of any suitable, flexible material (e.g., nylon or canvas cotton) attached to the main body [124] so as to form an opening to each pocket. The pockets [300], [305], [310] and [315] may be attached to the main body [124] in any suitable manner, including stitching. The flexible material may include an elastic material such as an elastic mesh material.

A top edge of pocket [310] may be attached to the main body [124], and a zipper [325] may be installed in the pocket [310] to allow access to its contents. Pockets may be stacked on one another. For example, pockets [320 ] and [322] may be attached to the material forming pocket [310].

FIG. 3 further illustrates that the organizational mechanisms [125] may include a hook [335], which may be used to secure a variety of items to the cot carrier [110], including items such as key chains, for example.

FIG. 3 further illustrates that the organization mechanisms [125] may include a cord mechanism [345] attached to the main body [124] of the cot carrier [110]. The cord mechanism [345] together with the main body [124] may form a loop that can be used to store items. For example, an item may be placed in between the main body [124] and the cord mechanism [345], or an item may be hung from the cord mechanism [345]. In certain embodiments, the cord mechanism [345] comprises stretchable material (i.e., an elastic material) capable of being stretched about an item to hold the item against the main body [124].

As shown in FIG. 3, the cord mechanism [345] may be attached at seams of pockets [315] and [310] and may include a first section [350] and second section [355]. The first section [350] may include a clip [360] that can be used to attach the first section [350] to a the second section [355].

While specific examples of the organizational mechanisms [125] have been illustrated in the drawings, it should be apparent that other types and arrangements of organizational mechanisms [125] may be used in alternative embodiments.

FIG. 3 further illustrates an exemplary embodiment of the attachment mechanisms [122]. The attachment mechanisms [122] may be constructed in any suitable manner that enables the cot carrier [110] to be attached to the cot [105]. For example, each of the attachment mechanisms [122] may include a strap and a ring (e.g., a "D-ring") attached to the main body [124] such that the strap may be looped around the support structure [115] and mated with the ring to removably attach the cot carrier [110] to the cot [105]. By way of another example, each of the attachment mechanisms [122] may include a hook mechanism attached to the main body [124] and configured to hook onto the support structure [115]. Of course, any other suitable type of attachment mechanism may be used for removably attaching the cot carrier [110] to the cot [105].

Figure 4:
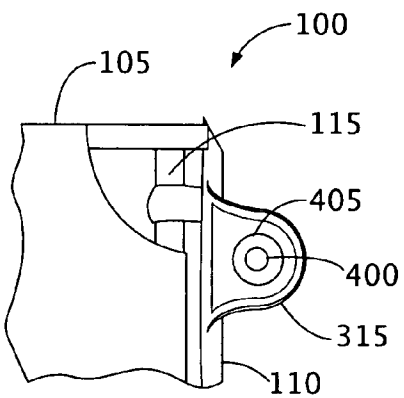
FIG. 4 is a top view of a portion of the assembly of FIG. 1, according to an embodiment.

FIG. 4 is a top view of a portion of the assembly [100] of FIG. 1, according to an embodiment. As shown in FIG. 4, pocket [315] of the cot carrier [110] may include a drainage hole [400]. The drainage hole [400] may be included in a bottom portion of pocket [315] in order to avoid any undesired collection of liquid in the pocket [315]. The drainage hole [400] may be formed by a disc [405] (e.g., a metallic disc) attached to the bottom portion of pocket [315], the disc [405] having the drainage hole [400] included therein. One or more other pockets (e.g., pocket [300]) may similarly include a drainage hole such as drainage hole [400].

In conclusion, the above-described exemplary multipurpose cot carrier is configured to provide multiple utilities, including, for example, an organizational tool useful for organizing items when the cot carrier is attached to a cot or other support structure at a campsite or other location, a carry tool for transporting the cot when the cot is in a stowed position, and a storage tool for storing the cot when the cot is in the stow position. The cot carrier may also be used as an organizational tool during transport and/or storage of the cot. The exemplary multipurpose cot carrier described herein can therefore help reduce the amount of clutter at a campsite, as well as the burden associated with transporting camping equipment to/from the campsite.

The preceding description has been presented only to illustrate and describe embodiments of the principles described herein. It is not intended to be exhaustive or to limit the disclosure to any precise form disclosed. The principles described herein may be practiced otherwise than is specifically explained and illustrated without departing from their spirit or scope. For example, while the exemplary cot carrier is described at being configured to attach to a support structure of a cot, the cot carrier may be configured to attach to any suitable support structure, including support structures associated with tents, for example. It is intended that the scope of the invention be defined by the following claims.

What is claimed is:

1. An assembly comprising:

a cot configured to be transitioned between a stow position and a sleep position; and a cot carrier including a flexible main body forming a compartment, said compartment being configured to receive said cot in said stow position, at least one organizational mechanism attached to said main body, at least one attachment mechanism attached to said main body, said at least one attachment mechanism being configured to attach said cot carrier to said cot when said cot is in said sleep position, and a flexible carry mechanism attached to said main body, wherein said flexible carry mechanism is arranged such that said at least one organization mechanism is in a generally upright position when said flexible carry mechanism is used to transport the apparatus with the cot stowed in said compartment.

2. The assembly of claim 1, wherein said at least one attachment mechanism is configured to attach said cot carrier to said cot such that said cot carrier hangs along an edge of said cot.

3. The assembly of claim 1, wherein said at least one organizational mechanism includes at least one cord mechanism attached to said main body, said main body and said at least one cord mechanism forming a generally horizontal loop.

4. The assembly of claim 3, wherein said at least one cord mechanism includes a first section and a second section, said first section including a clip configured to attach said first section to said second section to form said generally horizontal loop.

5. The assembly of claim 1, wherein said cot carrier includes a drawstring attached to said main body around an opening of said compartment, said drawstring being configured to constrict said opening.

6. The assembly of claim 1, wherein said at least one organizational mechanism includes at least one pocket, said pocket including a drainage hole.

7. The assembly of claim 1, wherein said cot includes a support structure, and wherein said at least one attachment mechanism includes at least one strap and at least one ring, said at least one strap and said at least one ring being configured to attach said cot carrier to said support structure of said cot in said sleep position.

* * * * *